US005937715A

United States Patent [19]

Lin

[11] Patent Number: 5,937,715

[45] Date of Patent: Aug. 17, 1999

[54] SOCKET FOR FASTENERS OF VARIOUS SIZES

[76] Inventor: Chin Ho Lin, No. 20, Lane 458, Guang Der Road, Tai Ping City, Taiwan

[21] Appl. No.: 08/914,813

[22] Filed: Aug. 19, 1997

[51] Int. Cl.[6] ..... B25B 13/58

[52] U.S. Cl. ..... 81/185; 81/DIG. 11

[58] Field of Search ..... 81/185, 124.4, 81/124.5, DIG. 11, 442, 448

[56] References Cited

U.S. PATENT DOCUMENTS 3,349,655 10/1967 Locke ..... 81/185

3,698,267 10/1972 Denney ..... 81/185

5,622,090 4/1997 Marks ..... 81/185

*Primary Examiner*—D. S. Meislin

[57] ABSTRACT

A socket includes a housing and a plate secured in the housing and having a number of apertures for slidably receiving a number of rods. A number of posts are secured to the rods and each includes a hexagonal cross section having six surfaces for engaging with the fasteners. A number of springs are engaged with the posts for allowing the posts to be depressed inward of the housing and for allowing the socket to engage with the fasteners of various sizes. The surfaces of the posts may solidly engage with the fastener for solidly retaining the fasteners in place.

3 Claims, 4 Drawing Sheets

SOCKET FOR FASTENERS OF VARIOUS SIZES

BACKGROUND OF THE INVENTION

1. Field of the Invention

The present invention relates to a socket, and more particularly to a socket for engaging with fasteners of various sizes.

2. Description of the Prior Art

A typical socket is shown in FIG. 6 and comprises a housing 70 having a hexagonal hole 72 for receiving a number of rods 74 which are provided for engaging with fasteners 76 of various sizes. The rods 74 each includes a circular cross section, such that the corners of the fasteners 76 may not be solidly retained in place such that the fasteners 76 may also be slightly rotated relative to the housing 70 and such that the corners of the fasteners 76 will be easily damaged.

The present invention has arisen to mitigate and/or obviate the afore-described disadvantages of the conventional sockets.

SUMMARY OF THE INVENTION

The primary objective of the present invention is to provide a socket which includes a number of hexagonal posts for solidly engaging with the fasteners and for preventing the corners of the fasteners from being damaged.

In accordance with one aspect of the invention, there is provided a socket comprising a housing including a hexagonal hole, a plate secured in the hexagonal hole and including a plurality of apertures, a plurality of rods slidably engaged in the apertures of the plate, the rods each including a head for engaging with the plate and for preventing the rods from being disengaged from the plate, a plurality of posts secured to the rods and moved in concert with the rods, the posts each including a hexagonal cross section having six surfaces formed on an outer peripheral portion for engaging with fasteners to be rotated, and means for biasing the posts away from the plate. The posts are allowed lo be depressed inward of the housing against the biasing means for allowing the socket to engage with the fasteners of various sizes. The surfaces of the posts are provided for engaging with an outer peripheral surface of the fastener and for solidly retaining the fasteners in place.

The housing includes a plurality of depressions, the plate includes a plurality of projections for engaging with the depressions and for securing the plate to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
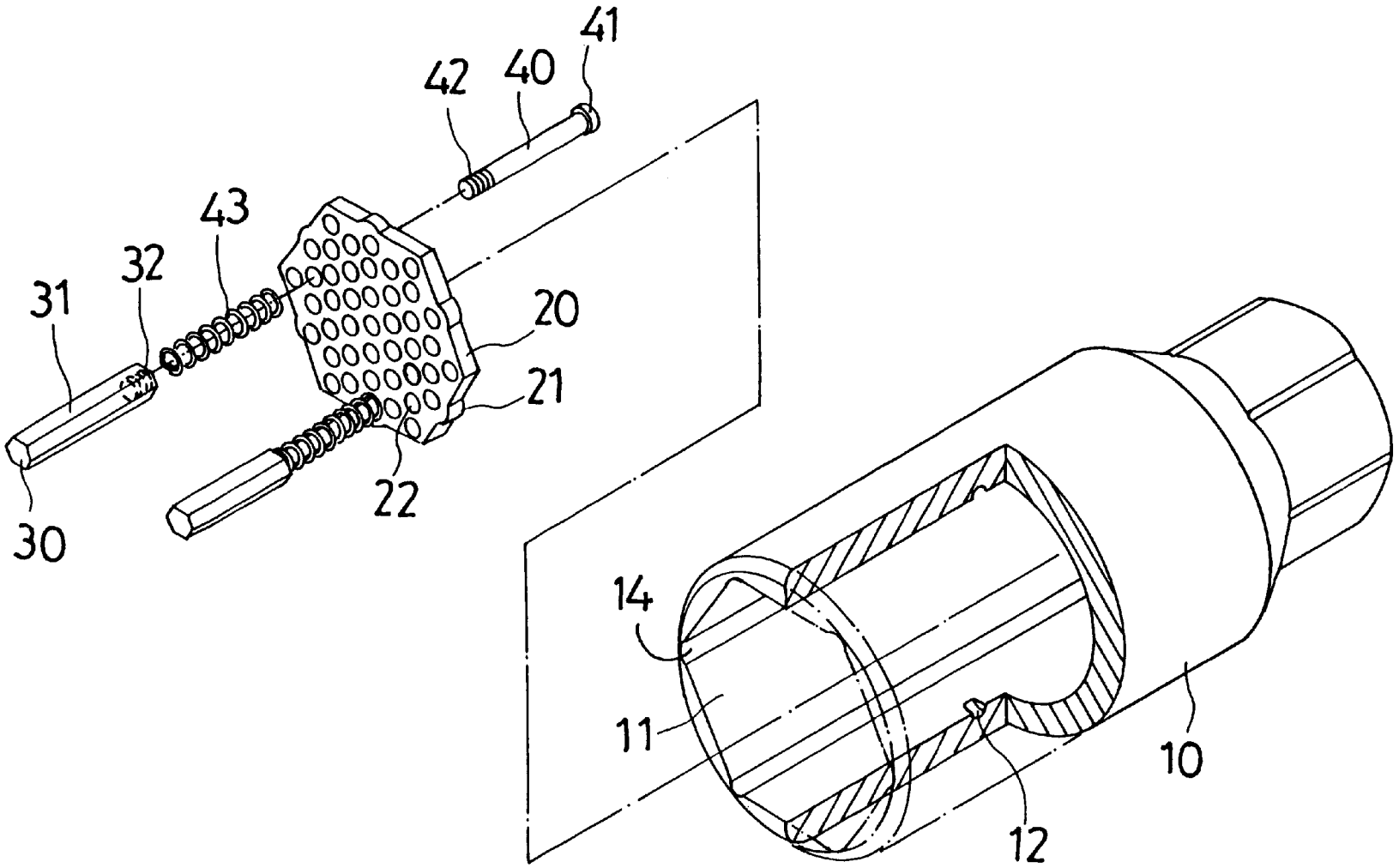
FIG. 1 is an exploded view of a socket in accordance with the present invention.
Figure 2:
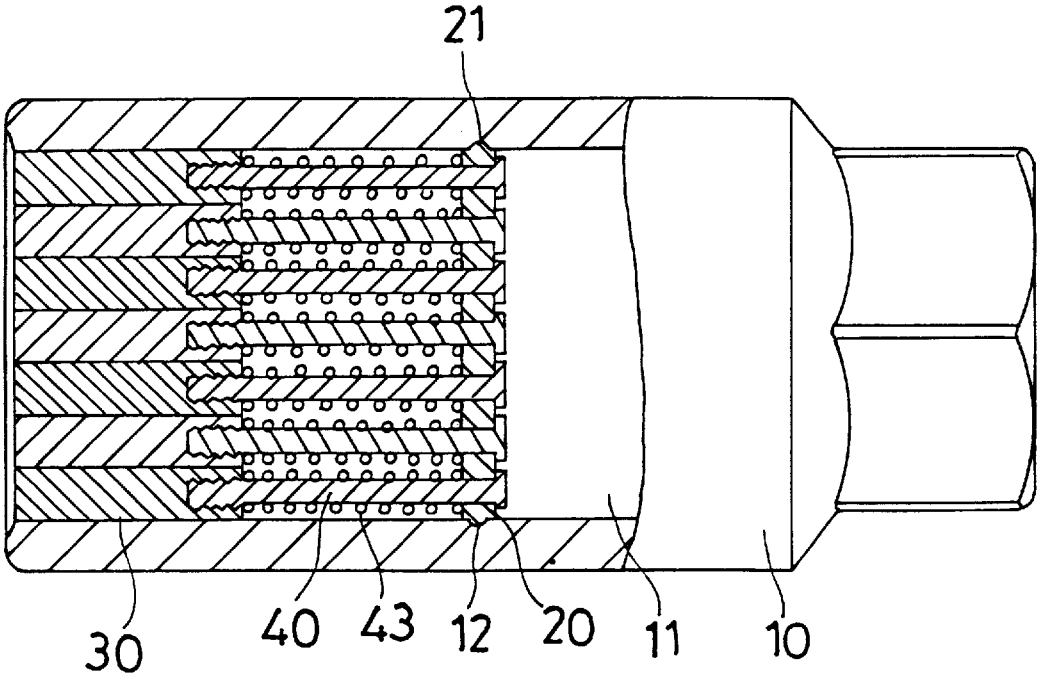
FIG. 2 is a cross sectional view taken along lines 2—2 of FIG. 3.
Figure 3:
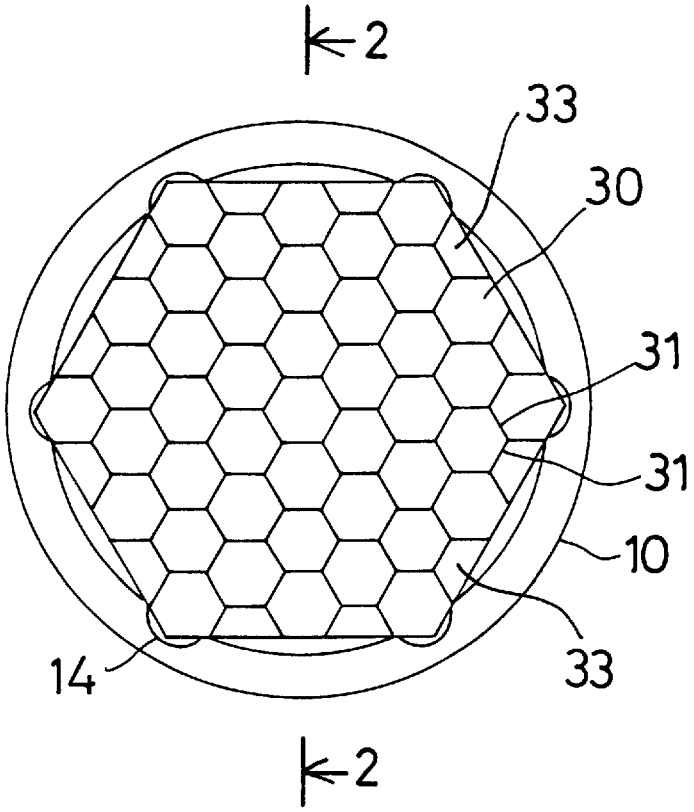
FIGS. 3, 4, 5 are end views of the socket, illustrating the operation of the socket.

Referring to the drawings, and initially to FIGS. 1–3, a socket in accordance with the present invention comprises a housing 10 including a hole 11 having a substantially hexagonal cross section and including a number of depressions 12 formed in the middle portion, and including six curved slots 14 formed in the corners of the hexagonal hole 11. A plate 20 includes a hexagonal cross section having a number of projections 21 for engaging with the depressions 12 of the housing 10 and for allowing the plate 20 to be secured in the middle portion of the hole 11 of the housing 10 when the plate 20 is force-fitted into the hole 11 of the housing 10. The plate 20 includes a number of apertures 22 for slidably engaging with a number of rods 40. The rods 40 each includes a head 41 formed on one end for engaging with the plate 20 and each includes an outer thread 42 formed on the other end. A number of hexagonal posts 30 each includes six flat surfaces 31 formed on the outer peripheral portion and each includes an inner thread 32 formed in one end for engaging with the outer thread 42 of the rods 40 such that the posts 30 are solidly secured to and moved in concert with the rods 40. A number of springs 43 are engaged on the rods 40 and biased between the plate 20 and the posts 30 for biasing the posts 30 away from the plate 20 and for allowing the posts 30 to be depressed inward of the housing 10 against the springs 43. The heads 41 of the rods 40 may prevent the rods 40 from being disengaged from the plate 20.

As best shown in FIG. 2, the plate 20 is secured in the middle portion of the housing 10 such that the hole 11 has about one half provided for receiving the rods 40 when the posts 30 and the rods 40 are depressed inwards of the hole 11. The curved slots of the housing 10 are provided for engaging with the corners of the plate 20 and the corners of some of the posts 30, as best shown in FIG. 3. The peripheral portion of the plate 20 may include several semi-hexagonal areas 33 having no posts 30.

Figure 4:
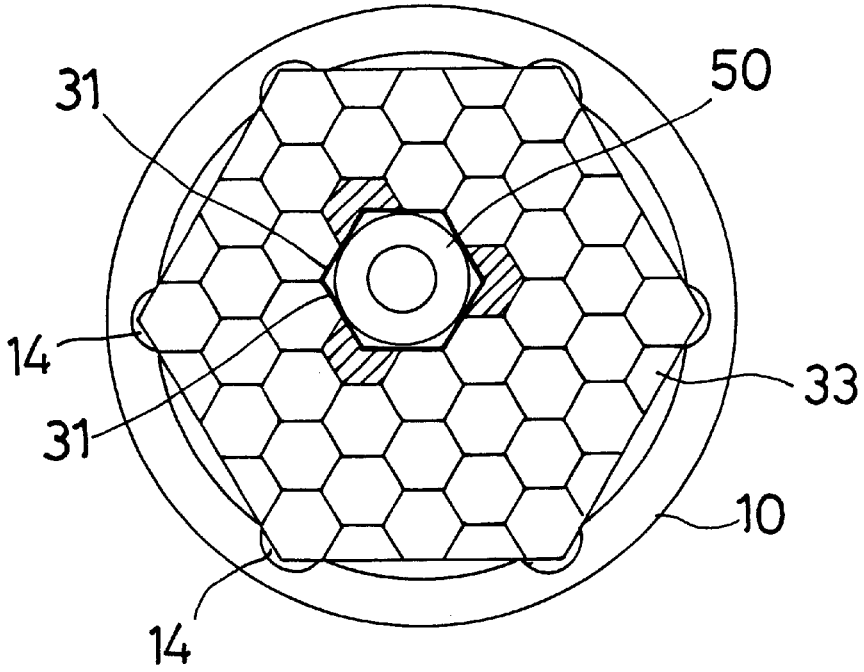
Figure 5:
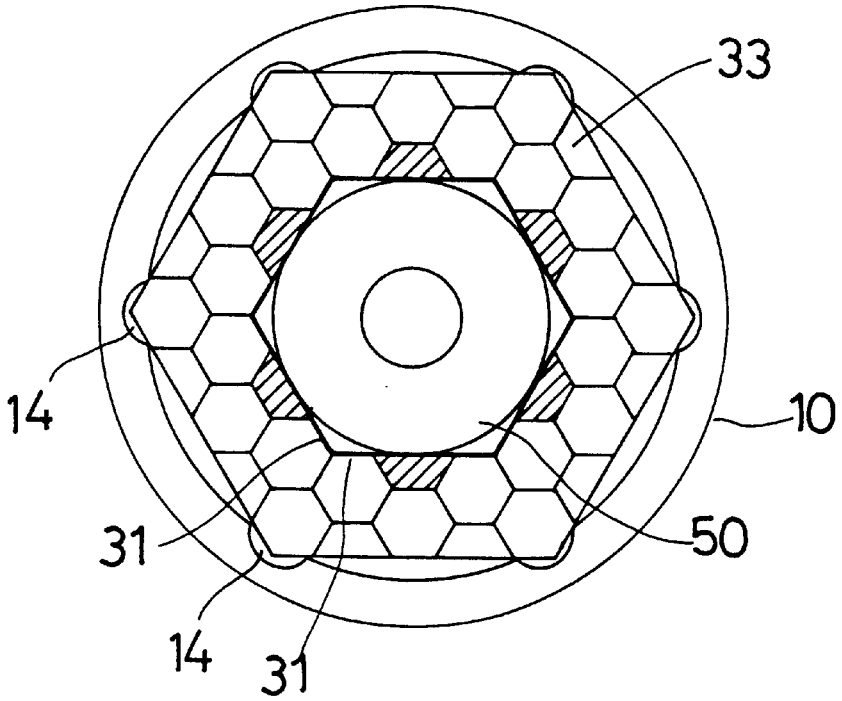
Figure 6:
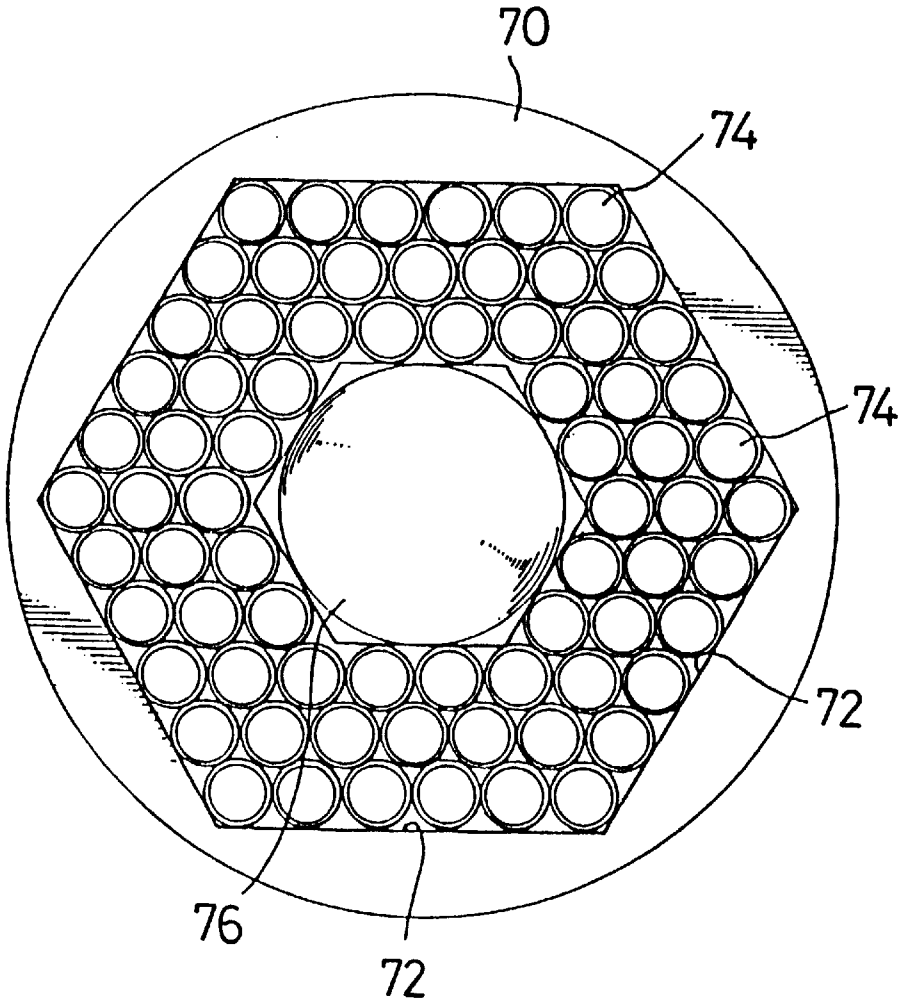
FIG. 6 PRIOR ART
FIG. 6 is an end view of a typical socket.

In operation, as shown in FIGS. 4 and 5, when the posts 30 of the socket are engaged with the fasteners 50 of various sizes to be rotated, the posts 30 may include six (FIG. 4) or twelve surfaces 31 (FIG. 5) for engaging with the peripheral surfaces of the fasteners 50 such that the fasteners 50 may be stably retained in place by the posts 30 and such that the fasteners 50 will not rotate relative to the housing 10. Three (FIG. 4) or six (FIG. 5) of the posts 30, as shown by hatch, may be depressed inward of the housing 10 against the springs 43.

Accordingly, the socket in accordance with the present invention includes a number of hexagonal posts for solidly engaging with the fasteners and for preventing the corners of the fasteners from being damaged.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A socket comprising:

a housing including a hexagonal hole having six corners and including six curved slots formed in said corners respectively, a plate secured in said hexagonal hole and including a plurality of apertures, a plurality of rods slidably engaged in said apertures of said plate, means for preventing said rods from being disengaged from said plate, a plurality of posts secured to said rods and moved in concert with said rods, said posts each including a hexagonal cross section having six surfaces formed on an outer peripheral portion for engaging with fasteners to be rotated and having six corners, and means for biasing said posts away from said plate, said posts being allowed to be depressed inward of said housing against said biasing means for allowing said socket to engage with the fasteners of various sizes, said surfaces of said posts being provided for engaging with an outer peripheral surface of the fastener and for solidly retaining the fasteners in place, one of said corners of each of six of aid posts being an outer corner, and each of said six curved slots of said housing receives one of said outer corners, respectively.

2. The socket according to claim 1, wherein said housing includes a plurality of depressions, said plate includes a plurality of projections for engaging with said depressions and for securing said plate to said housing.

3. The socket according to claim 1, wherein said rods each includes a head for engaging with said plate and for preventing said rods from being disengaged from said plate.

* * * * *

US005937715B1

REEXAMINATION CERTIFICATE (4150th)

United States Patent [19] [11] B1 5,937,715

Lin [45] Certificate Issued Sep. 5, 2000

[54] SOCKET FOR FASTENERS OF VARIOUS SIZES

[75] Inventor: Chin Ho Lin, No. 20, Lane 458, Guang Der Road, Tai Ping City, Taiwan

[73] Assignee: Chin Ho Lin, Tai Ping, Taiwan

Reexamination Request:
No. 90/005,550, Nov. 5, 1999

Reexamination Certificate for:

| | |
|---|---|
| Patent No.: | **5,937,715** |
| Issued: | **Aug. 17, 1999** |
| Appl. No.: | **08/914,813** |
| Filed: | **Aug. 19, 1997** |

[51] Int. Cl.[7] ..... B25B 13/58
[52] U.S. Cl. ..... 81/185; 81/DIG. 11
[58] Field of Search ..... 81/185, 124.4, 81/124.5, DIG. 11, 442, 448

[56] References Cited

U.S. PATENT DOCUMENTS

| | | |
|---|---|---|
| 4,887,498 | 12/1989 | Zayat . |
| 4,930,378 | 6/1990 | Colvin . |
| 5,284,073 | 2/1994 | Wright et al. . |
| 5,791,209 | 8/1998 | Marks . |

*Primary Examiner*—D. Meislin

[57] ABSTRACT

A socket includes a housing and a plate secured in the housing and having a number of apertures for slidably receiving a number of rods. A number of posts are secured to the rods and each includes a hexagonal cross section having six surfaces for engaging with the fasteners. A number of springs are engaged with the posts for allowing the posts to be depressed inward of the housing and for allowing the socket to engage with the fasteners of various sizes. The surfaces of the posts may solidly engage with the fastener for solidly retaining the fasteners in place.

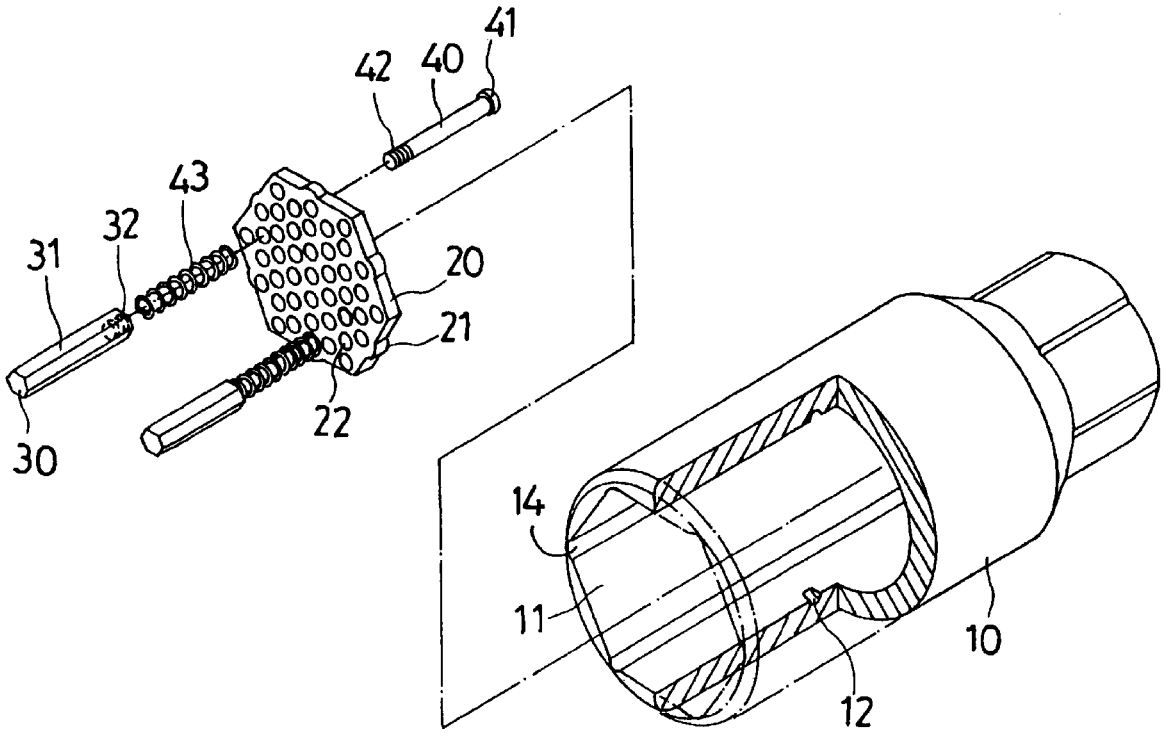

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–3 is confirmed.

* * * * *